United States Patent [19]

Jones et al.

[11] 3,942,694

[45] Mar. 9, 1976

[54] BAG SEVERING MACHINE

[75] Inventors: Elwyn David Jones, Beloeil; Derek Edgar Scuffell, Brownsburg, both of Canada

[73] Assignee: Canadian Industries Limited, Montreal, Canada

[22] Filed: Oct. 4, 1974

[21] Appl. No.: 512,128

Related U.S. Application Data

[62] Division of Ser. No. 395,937, Sept. 10, 1973, Pat. No. 3,871,269, which is a division of Ser. No. 207,306, Dec. 13, 1971, abandoned.

[52] U.S. Cl. ..... 225/100

[51] Int. Cl.[2] ..... B26F 3/00

[58] Field of Search ..... 225/96.5, 2, 100

[56] References Cited

UNITED STATES PATENTS

| | | | |
|---|---|---|---|
| 3,667,663 | 6/1972 | Kacmarcil | 225/100 |
| 3,727,814 | 4/1973 | Kuckhermann | 225/100 |
| 3,730,411 | 5/1973 | Brockmuller | 225/100 |
| 3,764,049 | 10/1973 | Ruesel et al. | 225/100 X |

*Primary Examiner*—Willie G. Abercrombie
*Assistant Examiner*—Leon Gilden
*Attorney, Agent, or Firm*—Alexander O. McIntosh

[57] ABSTRACT

A machine for severing individual plastic bags from a length of bags joined by perforated junctures. The length of bags is extended and severed by the action of two spaced apart sets of rollers, each set grasping the bags, the second set rotating with a higher surface speed than the first. During extension and severing the bags are supported by two overlapping conveyor belts travelling at speeds intermediate the surface speed of the two sets of rollers. The conveyor belts minimize the whipping of the severed edges of the bags. The bag severing machine is suited to operate in conjunction with equipment for folding plastic bags and inserting the folded bags in packages.

1 Claim, 3 Drawing Figures

BAG SEVERING MACHINE

This application is a divisional application to our copending patent application Ser. No. 395,937 filed on Sept. 10, 1973, which was a divisional application to our then copending patent application Ser. No. 207,306 filed on Dec. 13, 1971 and now abandoned.

This invention relates to a machine for producing stacks of plastic bags suitable for packaging.

Bags formed of plastic film such as polyethylene are used widely as containers. These bags commonly are produced by the transverse sealing and transverse severing of lengths of tubular film. Small size bags can be packaged as rolls of unsevered bags, the individual bags being joined along a line of perforations. Individual bags can then be detached as needed by tearing off along the perforated juncture. However, larger size bags cannot conveniently be packaged as rolls. In this case the package must contain several separate bags. In addition, in order to reduce the dimensions of the package to reasonable size it is necessary to fold the flattened bags at least once. The folding and packaging can be done manually but there is an economic advantage in carrying out most of the operations by machine. There is thus need for a machine to accumulate a stack of flattened bags and transfer this stack of bags to a container-filling station. Preferably such a machine will have means for folding the bags prior to the operation of stacking.

The machine of the present invention carries individual bags to a stack on a conveyor. The conveyor is adapted to advance when a predetermined number of bags have accumulated in the stack. The conveyor thus provides a stream of separate stacks of bags which may be removed manually from the conveyor for packaging.

It is thus the main object of the invention to provide in a continuing operation stacks of bags suitable for placing manually in packages. A further object of the invention is to provide means for folding plastic bags. Additional objects will appear hereinafter.

The machine for forming stacks of bags comprises:

1. an intermittently movable conveyor,
2. a moving belt carrier cooperating with said conveyor and adapted to hold individual bags by two opposite edges of the bag and carry said bags to a position above the conveyor,
3. a vertically operating reciprocatable ram located above said conveyor and belt carrier, said ram being adapted, in response to delivery of a bag by the belt carrier to a position above the conveyor, to push the bag downward from the belt carrier onto the conveyor, the ram retracting after each downward movement, thus accumulating a stack of bags on the conveyor, and
4. means for advancing the conveyor a distance greater than the dimension of the stack of bags on the conveyor thus separating the bags into groups, said advancing means being initiated in response to completion of a preselected number of operations of the ram.

Preferably the bags are folded prior to their delivery to the belt carrier. The folding may be carried out by means of an A-frame folder or by means of two coacting rollers or by both these means. The A-frame folder is suitable for forming longitudinal folds in a length of unsevered bags. The bags must be severed into separate bags before delivery to the belt carrier. The coacting roller folder is suitable for folding separate bags. In a combination of the two folding means it is necessary to interpose between them a means for severing the individual bags.

A suitable A-frame folder comprises a triangular frame positioned so that corner of the frame contacts the central part of a length of unsevered bags as it is guided through the folder, the bags thus assuming a V-shaped fold, and two coacting rollers positioned so that the bite of the rollers bisects the V-shaped fold of the length of bags, the length of the bags after passing over the frame passing between the two rollers to complete the fold.

A suitable roller folder comprises two coacting rollers and an air nozzle adapted to direct a synchronized blast of air into the bite of the two rollers, the operation of the blast of air being initiated when a bag passing over the upper parts of both rollers lies with its midpoint above the bite of the rollers, the blast of air forcing the midpoint of the bag between the rollers.

A suitable means for severing the individual bags from a length of bags joined by perforated junctures comprises two sets of double coacting rollers, the surface of the second set being adapted to travel at a higher speed than the surface of the first set so that the length of bags passing first between the first set of rollers and then between the second set of rollers is extended thus separating the bags at the perforated juncture.

Advantageously, the length of bags passing between the two sets of double rollers is supported between cooperating upper and lower endless conveyor belts which travel at a speed intermediate that of the surface speed of the two sets of rollers so that when the perforated juncture of the bags is severed the whip action of the severed ends is minimized.

A preferred embodiment of the invention is illustrated in the accompanying drawings wherein.

Figure 3:
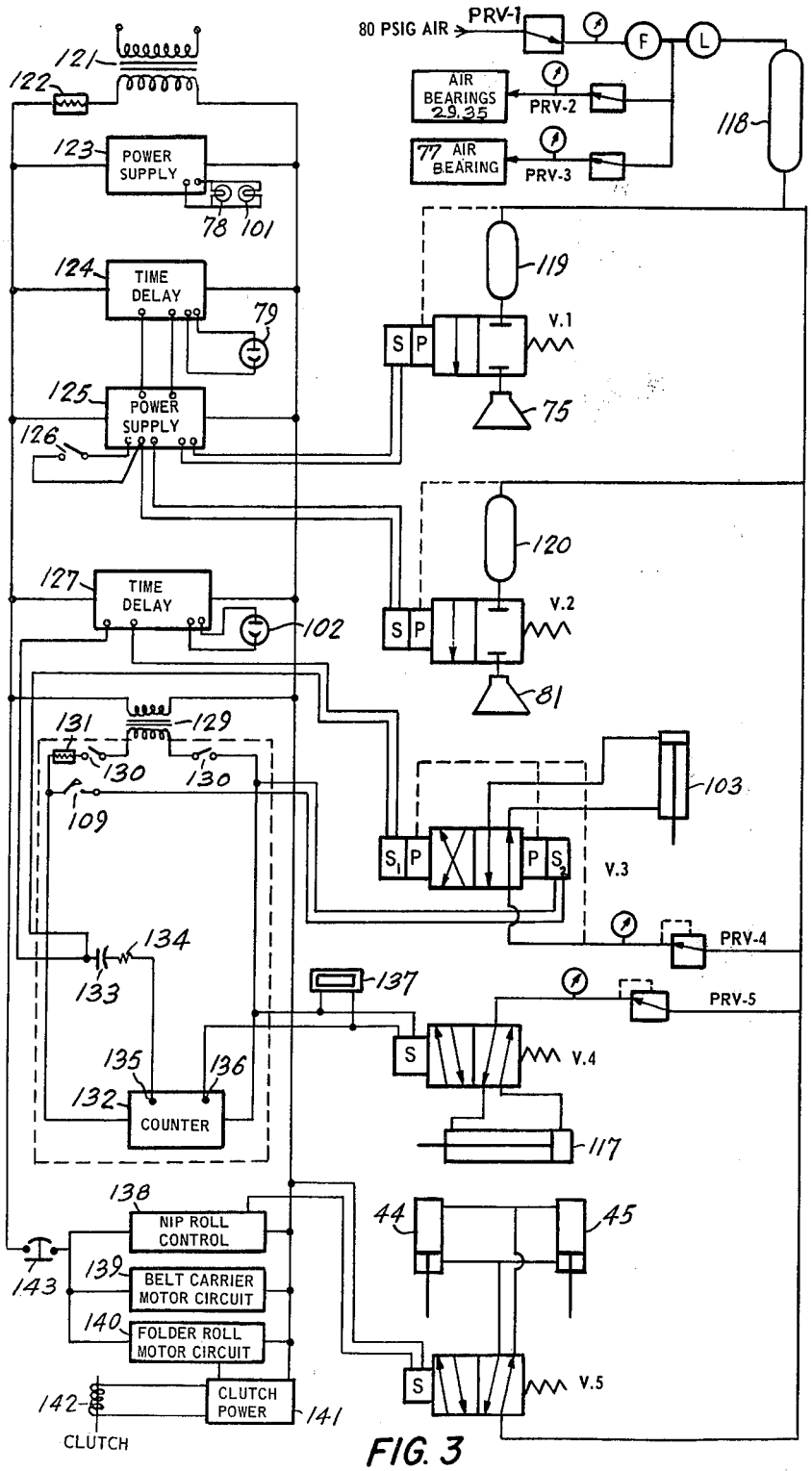
FIG. 3 is a diagram of the electrical and pneumatic control system of the machine of FIG. 1.

The air valves illustrated in FIG. 3 have the following characteristics:

V.1 A two-way solenoid actuated, pilot air assisted, spring return valve.

V.2 A two-way solenoid actuated, pilot air assisted, spring return valve.

V.3 A four-way double solenoid actuated, pilot air assisted valve, the two solenoids being designated as $S_1$ and $S_2$.

V.4 A four-way solenoid actuated, spring return valve.

V.5 A four-way solenoid actuated, spring return valve.

PRV-1, PRV-2, PRV-3, PRV-4, PRV-5 are pressure regulator valves having pressure gauges.

Referring to the drawings, a roll of bags wherein the constituent bags are joined by perforated junctures is shown at 1. The roll is mounted on a shaft 2 which is rotatable in bearings carried by brackets 3 and 4. The joined bags pass from roll 1 under rollers 5 and 6 to an accumulator comprising rollers 7, 8 and 9 rotatable in bearing carried by frame members 11 and 12 and rollers 13 and 14 rotatable in bearings 15, 16 slidable on vertical guides 17 and 18 respectively. The motion of bearings 15, 16 on guides 17, 18 is restricted by helical springs 19, 20 and 21, 22. There are of course matching sets of bearings and guides at each end of rollers 13 and 14. The function of the accumulator is to maintain the length of joined bags taut as it passes through the machine.

After passing through the accumulator the length of joined bags is folded twice longitudinally by passage over two consecutive A-frames. The A-frames and accessory rollers are mounted in a framework of which 11 and 12 are two upper horizontal members and 23 and 24 are two vertical members. The length of joined bags passes from accumulator roller 9 to roller 25 at the top of the framework. From roller 25 the length of bags passes over A-frame 26. A-frame 26 is a triangular shaped guide attached at two corners to brackets 27 carried by the framework. The third corner of the A-frame is positioned at a midpoint of the length of bags, lying lower than the corners attached to brackets 27. The A-frame is maintained in its slanting position by means of rod 28 attached to both the A-frame and the framework member.

The inclined edges of the A-frame are fitted with air bearings 29. These are constituted by perforated tubes attached to a supply of compressed air. The air bearings reduce the friction between the A-frame and the bags passing over it.

Below the A-frame 26 is positioned a pair of coacting rollers 30, 31. These rollers are rotatable in bearings carried by a cross member of the framework. The bite of rollers 30, 31 lies directly beneath the lower corner of the A-frame. The length of bags passing over the A-frame is folded into a V-shaped longitudinal fold. This folded length then passes between rollers 30, 31 completing the fold.

Beneath rollers 30, 31 lies a second, smaller A-frame 32. Two corners of A-frame 32 are attached to the framework through rods 33, 34. A rod, not shown, maintains A-frame 32 in a slanting position. The inclined edges of A-frame 32 are fitted with air bearings 35. Beneath A-frame 32 are positioned coacting rollers 36, 37. The bite of rollers 36, 37 lies beneath the lower corner of A-frame 32. The once folded length of bags issuing from rollers 30, 31 is folded longitudinally a second time as it passes over A-frame 32 and between rollers 36, 37.

The twice folded length film next passes upwards and over roller 38. Roller 38 is rotatable in bearings carried by brackets 39 fixed to vertical members 24 of the framework. From roller 38 the length of bags passes between coacting nip rolls 40, 41. To the ends of these rolls are fixed meshing gears 40A, 41A respectively. Lower roll 40 is driven, being journalled in bearings in the framework of the machine. Upper roll 41 rotates through the action of meshing gears 40A, 41A. Upper roll 41 is journalled in bearings carried by matching blocks 42 slidable vertically between guides in frame members 43. Blocks 42 are fixed to the pistons of double acting air cylinder-piston units 44, 45. It is thus possible to raise roll 41 to assist in threading the length of bags through the nip rolls. The nip rolls serve to draw the length of bags through the A-frame folding assembly.

Figure 1:
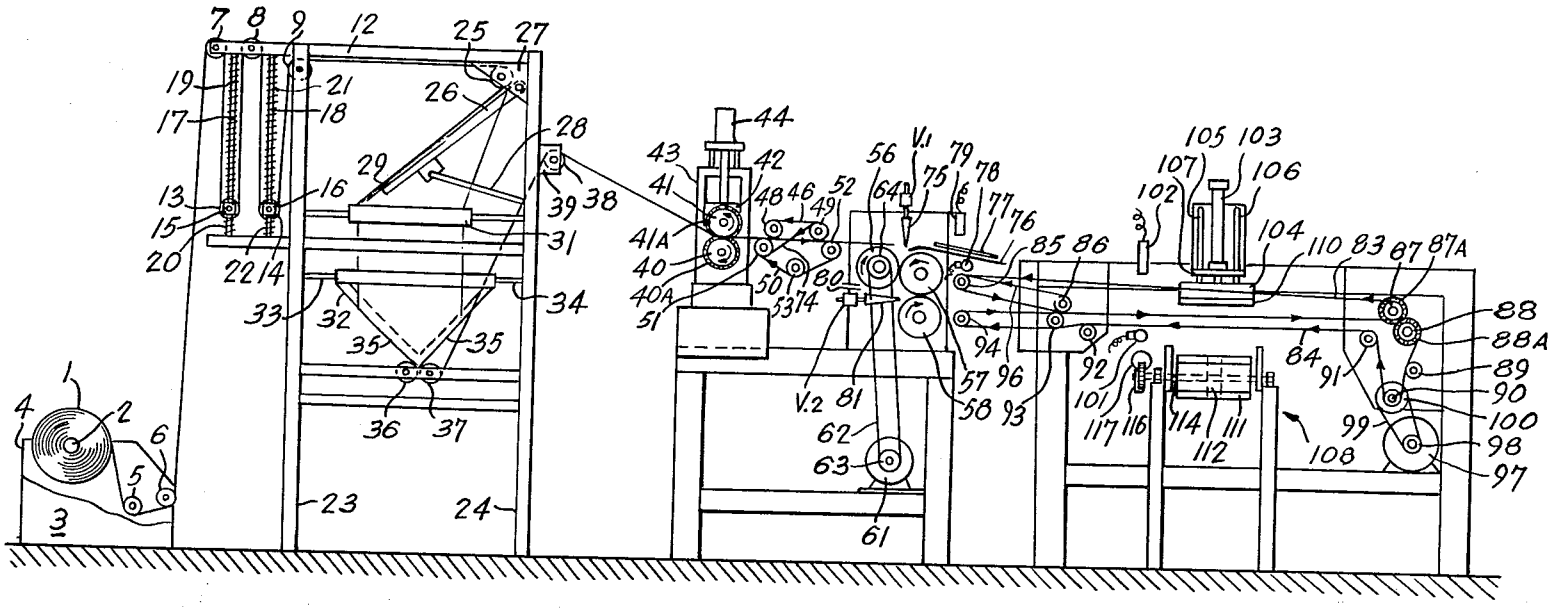
FIG. 1 is a front view of a machine for folding and stacking bags.
Figure 2:
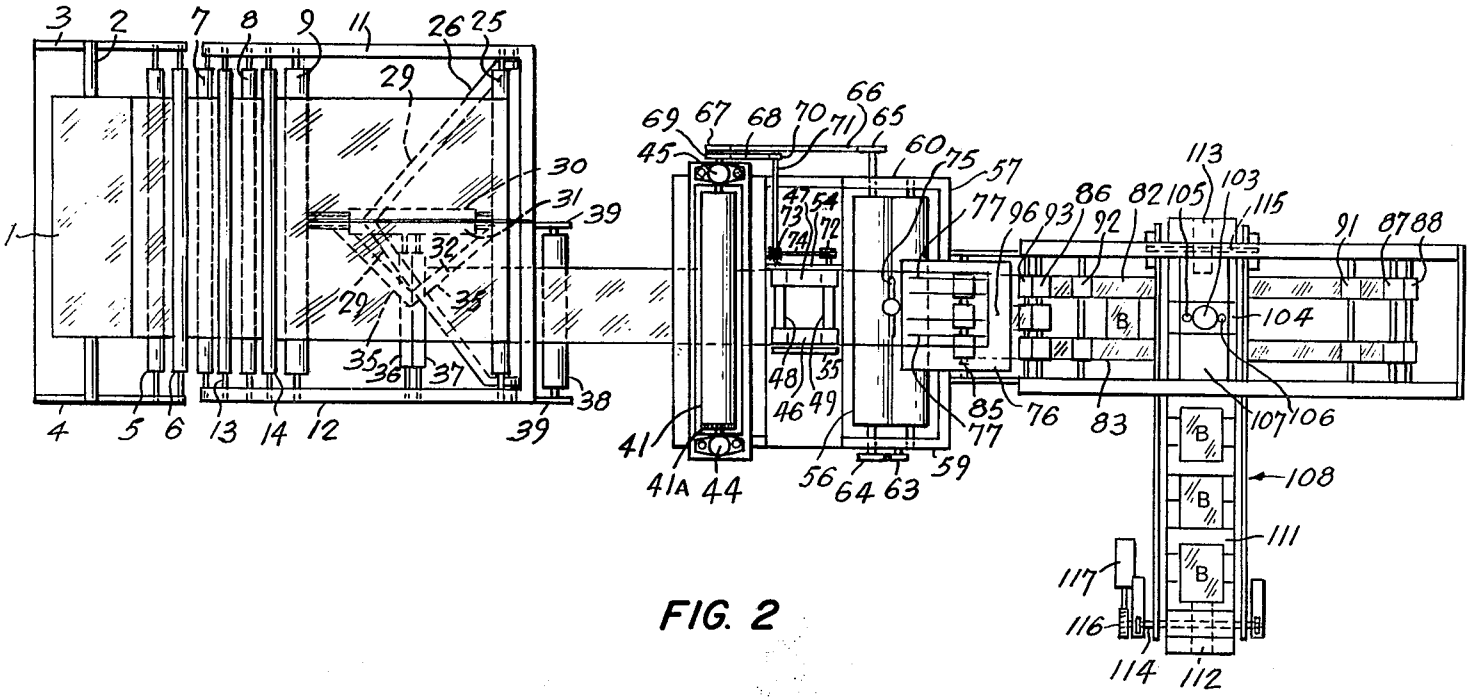
FIG. 2 is a plan view of the machine of FIG. 1.

After issuing from the nip rolls the length of bags passes between a double conveyor belt unit formed of cooperating upper and lower belt systems. This unit has four endless belts. The upper belts 46, 47 are carried by double rollers 48, 49. The lower belts, one of which is shown at 50 in FIG. 1, are carried by three double rollers 51, 52 and 53. Roller 53 is an idler serving to maintain the belts taut. Rollers 48, 49, 51, 52 and 53 turn in bearings carried by support plates 54, 55.

From the conveyor belt unit the length of bags passes over a set of three coacting folder rolls 56, 57, 58. The surfaces of rolls 56 and 57 are in contact as are the surfaces of rolls 57 and 58. These rolls are journalled in bearings carried by plates 59 and 60 of the machine frame. Roll 56 is driven by electric motor 61 by means of belt 62 running over motor pulley 63 and roll pulley 64 mounted on the shaft of roll 56. Roll 56 also has another shaft mounted pulley 65 which serves to drive nip roll 40 through belt 66 and pulley 67 mounted on the shaft of the nip roll. The conveyor belt unit is driven through belt 68 which passes over pulley 69 mounted on the shaft of nip roll 40 and pulley 70 mounted on shaft 71 which is an extension of roller 51. The upper endless belt of the conveyor belt unit is driven through pulley 72 attached to roller 49, pulley 73 attached to roller 51 and connecting belt 74. Upper and lower endless belts travel at the same speed but rotate in reverse sense. The system of pulleys and belts connecting the nip rolls, belt conveyor and folder rolls is so devised that the surface of the folder rolls is greater than the surface speed of the nip rolls and the speed of the conveyor belt lies between the surface speeds of the folder rolls and nip rolls.

Ejecting into the bite of folder rolls 56, 57 is air nozzle 75. Passage of air to nozzle 75 is controlled by valve V.1. The length of bags passes over roll 56, under nozzle 75 and onto support plate 76 which is positioned above roll 57. Plate 76 has four air bearings consisting of four perforated tubes 77 fed with compressed air. The perforations are directed to urge the length of bags to the right. Plate 76 is fitted with an opening through which light from incandescent lamp 78 shines. Light from 78 impinges upon photocell 79. However, when the end of the length of bags is interposed between 78 and photocell 79 a signal is stored in a delay circuit which can be adjusted to actuate valve V.1 when the midpoint of the bag length is precisely over the bite of rolls 56 and 57. The momentary actuation of valve V.1 sends an air blast through nozzle 75 and the folded midpoint of the bag is forced into the bite of coacting rolls 56 and 57. The rolls seize the bag folding it transversely and since the surface velocity of rolls 56, 57 is greater than that of nip rolls 40, 41 the bag is torn from the length of bags at the perforated juncture which lies at a position between these two sets of rolls. The perforated juncture lies between belts 46, 47, 50 of the belt conveyor which are travelling at a speed intermediate the surface speeds of the nip rolls and folder rolls. The belt conveyor functions to minimize whipping of the separated edges of the bags at the perforated juncture.

As folded separated bag passes between folder rolls 56, 57 it is prevented from clinging to roll 56 by a stream of air issuing from nozzle 80. The bag then passes between folder rolls 57, 58 and air nozzle 81. The air supply to nozzle 81 is controlled by valve V.2. The control circuit actuating valve V.1 is adapted after a preselected time delay to actuate valve V.2. Thus a blast of compressed air from nozzle 81 drives the midpoint of the folded bag into the bite of coacting folder rolls 57, 58. The rolls seize the bag and fold it transversely a second time.

The folded bag is ejected from folder rolls 57, 58 into the inlet of a belt carrier. This carrier is formed of six endless belts supported by a system of 10 rollers. Four long belts, three of which are shown at 82, 83, 84 pass over rollers 85, 86, 87, 88, 89, 90, 91, 92, 93, 94. The belts are in two sets of upper and lower belts, each set passing over the extremities of the rollers leaving a free space between the belts. The upper and lower belts of each set are in contact over part of their traverse, travelling at the same linear speed. The long belts thus are adapted to hold the folded bags between two sets of contacting belts by two opposite bag edges, leaving the intermediate portion of the bag free. Two short belts, upper and lower, are supported by the inner portions of rollers 85, 86, 93, 94. The upper belt is shown at 96. These belts serve to support the intermediate portion of the folded bag at the inlet section of the belt carrier. The rollers are journalled in bearings carried by the framework of the machine. Rollers 89 and 92 act as idlers to maintain the belts taut.

The power to drive the belt carrier is provided by electrical motor 97. The shaft of this motor carries a pulley 98 which, through belt 99 drives pulley 100 on the shaft of roller 90. Only the lower long belts pass over roller 90, the upper long belts being driven through gears 87A and 88A fixed to rollers 87 and 88 respectively.

When the folded bag B held by the belt carrier passes between lamp 101 and photoelectric cell 102 the latter acts through a control circuit to actuate valve V.3. Valve V.3 then directs compressed air to air cylinder-piston unit 103 to extend the piston thereof. The cylinder of 103 is attached to plate 107 fixed to the framework of the machine, the piston to the head 104 of a ram assembly which includes two guide rods 105, 106 slidable in bores in plate 107. When head 104 is driven down by the piston of cylinder-piston unit 103 it pushes the folded bag, which has now advanced under the head, from the belt carrier and deposits it upon the conveyor shown generally at 108.

As the head 104 moves downward a cam actuated electrical switch 109 (FIG. 3) is closed by a cam carried by the head. The closing of switch 109 acts through the control circuit to reverse the position of valve V.3 which in turn directs air to cylinder-piston unit 103 to raise the head 104 of the ram assembly. The surface of head 104 is covered with a layer of elastic material 110 such as foam rubber. It is of advantage to provide head 104 with air lines exhausting air from cylinder 103 through its surface contacting the folded bag. A stream of air issuing from the surface of the head during action of the cylinder-piston unit assists in the rapid separation of the folded bag when the head is retracted. It is clear that the repeated action of the carrier belt and ram assembly will form a stack of folded bags on the conveyor.

Conveyor 108 comprises a movable belt system formed of flexibly linked plates 111. The belt system turns about two gears 112, 113 mounted on shafts 114, 115 journalled in bearings carried by the framework of the conveyor. The belt system is driven by gear 112 upon whose shaft 114 there is mounted a ratchet wheel 116. A pawl bracket mounted on shaft 114 carries a pawl engaging ratchet wheel 116. The pawl bracket is linked to the end of the piston of air cylinder-piston unit 117. The air supply to cylinder-piston unit 117 is controlled by air valve V.4. A control circuit acting in response to the operation of valve V.3 actuates valve V.4 after a predetermined number of bags have been driven by the ram onto the conveyor. The resulting action of cylinder-piston unit 117 turns ratchet wheel 116 by action of the pawl and pawl bracket linked to its piston. Thus the conveyor belt is advanced by a predetermined increment moving the stack of bags from beneath the ram assembly. The carrier belt and ram assembly then proceed to form another stack of bags on the conveyor.

The stacks of bags may be removed from the conveyor manually or may be deposited by the conveyor in a container located at the end of the conveyor belt.

The coordination of the several elements of the machine is carried out by means of the electrical and pneumatic control system illustrated in FIG. 3.

Compressed air, conveniently at a pressure of 80 p.s.i.g. passes from an air supply through pressure regulator valve PRV-1 to filter F. A branch line provides air, controlled by pressure regulator valves PRV-2 and PRV-3, for air bearings on A-frames (29, 35) and on folder plate (77) respectively. The main air line then passes through lubricator L through reservoir 118 to air valves V.1, V.2, V.3, V.4 and V.5. The inputs to valves V.1 and V.2 are provided with reservoirs 119, 120. Lines carrying pilot air bypass these reservoirs.

The inputs to valves V.3 and V.4 are provided with pressure regulator valves PRV-4 and PRV-5 respectively. Pilot air is supplied also to valve V.3.

These air valves are actuated by an electrical control circuit powered through transformer 121 and protected by fuse 122. Power supply 123 provides regulated power for lamps 78, 101 used to excite photocells 79 and 102. Photocell 79 acts through time delay circuit 124 and power supply 125 to send a pulse of electric power to the solenoid of valve V.1 actuating this valve momentarily. Then after a preset interval delay circuit 124 sends a pulse to the solenoid of valve V.2 actuating this momentarily. These valves control the air supply to folder roll nozzles 75 and 81 respectively. Switch 126 permits valve V.2 to be disabled so that only nozzle 75 is operated.

Photocell 102 acts through time delay circuit 127 to send a pulse of electric power to solenoid $S_1$ of valve V.3. This causes cylinder-piston unit 103 to lower head 104 of the ram assembly. Head 104 as it descends operates cam controlled switch 109 sending a pulse to solenoid $S_2$ of valve V.3 raising head 104 to its original position.

Valve V.4, controlling cylinder-piston unit 117 of the conveyor advance mechanism, is actuated through a counter circuit coordinated with the operation of valve V.3.

The counter circuit is isolated from the other circuit elements by means of transformer 129. The counter circuit is also provided with double switches 130 and fuse 131. The main element of the counter circuit is counter 132. This is a known device adapted to energize valve V.4 after receiving a preselected number of pulses from the circuit of solenoid $S_1$ of valve V.3. These pulses originate when $S_1$ is energized, being transmitted through capacitor 133 and resistance 134 to input terminal 135 of the counter. Output terminal 136 of the counter is connected to the solenoid of valve V.4. Also in the solenoid circuit of valve V.4 is indicating counter 137 which indicates the total of operations of valve V.4, thus giving the number of stacks of bags deposited upon the conveyor.

Also contained in the control circuit is nip roll control 138. This is the electrical circuitry, including a control relay, adapted to permit valve V.5 controlling nip roll cylinder-piston units 44, 45 to be maintained open or shut.

The belt carrier motor circuit 139 includes a control relay and controls motor 97.

Folder roll motor circuit 140 includes a control relay and provides control of motor 61. As auxiliary to the folder roll motor circuit is the power supply 141 for clutch 142. The clutch links motor 61 to motor pulley 63.

Switch 143 provides a means of shutting down the machine under emergency situations.

Employing the machine of this invention plastic bags formed from polyethylene can be folded and stacked at the rate of at least 120 bags per minute.

What we claim is:

1. A machine for severing individual bags from a continuously fed length of bags joined by perforated junctures which comprises first and second spaced apart sets of double coating rollers, the second set of rollers being positioned downstream from the first set of rollers, and positioned intermediate said first and second set of rollers a bag support means comprising a lower endless conveyor belt and in contact therewith a cooperating upper endless conveyor belt, said cooperating conveyor belts being adapted to support the length of bags between the contacting surfaces of the belts as the length of bags passes from between the first set of rollers to the second set of rollers, the second set of rollers being adapted to grasp the length of bags issuing from between the conveyor belts, and means for driving the two sets of rollers and intermediate conveyor belts so that the surface speed of the second set of rollers is greater than the speed of the conveyor belts and the speed of the conveyor belts is greater than the surface speed of the first set of rollers, thus extending the length of bags as it passes from the first set of rollers to the second set of rollers so as to sever the individual bags at the perforated junctures, the individual severed bags being delivered from between the second set of rollers.

* * * * *